United States Patent [19]

Kiess

[11] 4,228,780

[45] Oct. 21, 1980

[54] CAPACITOR DISCHARGE IGNITION SYSTEM WITH TIMING CONTROL ARRANGEMENT

[75] Inventor: Ronald J. Kiess, Decator, Ind.

[73] Assignee: Wabash, Inc., Wabash, Ind.

[21] Appl. No.: 14,141

[22] Filed: Feb. 22, 1979

[51] Int. Cl.[3] ..... F02P 3/08; F02P 3/06

[52] U.S. Cl. ..... 123/596; 123/605; 315/209 SC; 315/209 CD

[58] Field of Search ..... 123/148 CC, 148 E, 148 CB, 123/148 CA, 149 C, 149 D, 118; 315/209 SC, 209 CD, 218; 310/70 A, 153

[56] References Cited

U.S. PATENT DOCUMENTS

| | | | |
|---|---|---|---|
| Re. 29,374 | 8/1977 | Just et al. | 315/209 SC |
| 3,447,521 | 6/1969 | Piteo | 123/148 CC |
| 3,484,677 | 12/1969 | Piteo | 123/148 E |
| 3,500,809 | 3/1970 | Höhone et al. | 123/148 CC |
| 3,703,889 | 11/1972 | Bodig et al. | 123/118 |
| 3,704,701 | 12/1972 | Strüber et al. | 123/148 E |
| 3,722,488 | 3/1973 | Swift et al. | 123/148 CC |
| 3,851,636 | 12/1974 | Just et al. | 123/148 E |
| 3,941,111 | 3/1976 | Carmichael et al. | 123/149 C |
| 4,036,201 | 7/1977 | Burson | 123/148 CC |
| 4,056,088 | 11/1977 | Carmichael | 123/148 CC |
| 4,074,669 | 2/1978 | Cavil et al. | 315/218 |
| 4,132,208 | 1/1979 | Yakawa | 315/209 SC |

*Primary Examiner*—P. S. Lall

*Attorney, Agent, or Firm*—Mason, Kolehmainen, Rathburn & Wyss

[57] ABSTRACT

A capacitor discharge ignition system is provided with an ignition timing control arrangement to achieve a predetermined ignition timing retard characteristic at high engine speeds and thus provide engine speed control. The capacitor discharge ignition system is positioned adjacent a rotating permanent magnet that is rotated over a path in synchronism with the operation of an engine to be controlled.

The capacitor discharge ignition system includes a stator core having disposed thereon an ignition coil and a control coil. As a first pole of the magnet passes the stator core, a voltage and current of a first polarity is induced in the control coil to charge a storage capacitor. As the second pole of the magnet passes the stator core, a voltage and current of the opposite polarity is induced in the control coil and a control arrangement responsive to the control coil discharges the capacitor into a primary winding of the ignition coil. The induced voltage and current in a secondary winding of the ignition coil provides suitable power conditions to fire a spark plug or spark plugs connected across the secondary winding. The capacitor discharge ignition system provides a high output voltage while preventing excessively high reverse voltages to the various components of the system.

16 Claims, 4 Drawing Figures

CAPACITOR DISCHARGE IGNITION SYSTEM WITH TIMING CONTROL ARRANGEMENT

This application is related to copending application Ser. No. 927,772 filed on July 22, 1978 by Ronald J. Wolf. The capacitor discharge system of application Ser. No. 927,773, now U.S. Pat. No. 4,202,305 is directed to an improvement of the ignition system of the present invention to provide an ignition timing stabilization arrangement achieving a substantially constant ignition timing characteristic.

BACKGROUND OF THE INVENTION

A. Field of the Invention

This invention relates generally to capacitor discharge ignition systems and more particularly to an ignition control arrangement for engine speed control.

B. Description of the Prior Art

Various capacitor discharge systems of the prior art have been developed to provide a breakerless ignition system for the control of an engine whereby an appropriately timed signal is supplied to the primary winding of an ignition coil to induce a high voltage in a secondary winding of the ignition coil to fire a spark plug or spark plugs associated with the engine.

The capacitor discharge systems of the prior art utilize various circuit arrangements and coil arrangements including triggering and charging coils in combination with a rotating permanent magnet on the engine flywheel to induce current in a charging coil, charge a capacitor with the induced current and discharge the capacitor into the primary winding of an ignition coil. Such arrangements are shown for example in U.S. Pat. No. 3,941,111 which issued to T. F. Carmichael on Mar. 2, 1976; U.S. Pat. No. 4,056,088 which issued to T. F. Carmichael on Nov. 1, 1977; U.S. Pat. No. 4,036,201 which issued to B. O. Burson on July 19, 1977; U.S. Pat. No. 3,500,809 which issued to G. Hohne on Mar. 17, 1970; U.S. Pat. No. 3,851,636 which issued to F. H. Just et al on Dec. 3, 1974; U.S. Pat. No. 3,703,889 which issued to B. Bodig et al on Nov. 29, 1972; U.S. Pat. No. 3,704,701 which issued to G. Streuber et al on Dec. 5, 1972; U.S. Pat. No. 3,484,677 which issued to M. J. Piteo on Dec. 16, 1969; and U.S. Pat. No. 3,722,488 which issued to T. E. Swift et al on Mar. 27, 1973.

The capacitor discharge ignition (CDI) systems of the prior art have also provided arrangements to advance the timing at higher engine speeds for improved engine performance and to provide proper ignition timing over a wide range of engine speeds to enable proper ignition at low RPM and to prevent excessive retarding of the engine timing or spark at very high engine RPM's.

For example in U.S. Pat. No. 3,941,111, a CDI system is disclosed wherein a capacitor is charged through a charge coil during a first portion of a pulse of one polarity and an SCR is triggered during a second portion of the same pulse to discharge the capacitor into the primary winding of an ignition coil. In FIG. 2 of this patent, the primary winding controls the SCR by means of a resistor-capacitor network. Specifically, a resistor 50 is connected between one end of a primary winding and the control gate electrode of the SCR and a capacitor is connected between the control electrode of the SCR and the other end of the primary winding. Further, an additional resistor 48 is connected across the capacitor

38 to prevent the spark from retarding at very high engine RPM.

In U.S. Pat. No. 4,056,088 and referring specifically to FIGS. 3 and 4, the CDI system disclosed therein provides an advance in ignition timing of approximately 8° to 10° at higher engine speeds. At column 5, lines 38 through 59, it is stated that the effect is highly desirable although the exact cause of the advance is not fully understood. The specification states that it is thought to be a part of the function of the spacing of the legs 22A and 22B of the stator core 22 relative to the spacing of the poles 18 and 20 of the permanent magnet structure carried by the flywheel.

In U.S. Pat. No. 3,500,809 there is disclosed a circuit arrangement to provide an automatic advancement of the timing or spark at higher engine speeds. This is accomplished by the control voltage to the SCR 7 rising faster with increased speed of the engine. A resistor-capacitor network or a shorting coil is provided to control this effect with varying engine speeds.

The automatic timing advance arrangement disclosed in U.S. Pat. No. 3,722,488 utilizes a trigger waveform including a first high speed trigger peak and a second low speed trigger peak. Specifically, the trigger waveform with two peaks is generated in a trigger coil; the trigger waveform including two distinct positive peaks with an appropriate timing relationship. The first trigger peak at low engine speeds is insufficient to trigger the control circuitry to discharge a charging capacitor. At low speeds the second, higher peak triggers the system at a point later in time and thus retarded with respect to the occurrence of the first peak. At high engine speeds, the first, lower level peak is sufficient to trigger the system and thus occurs at an advanced time with respect to the second peak. As the engine speed increases to a predetermined speed, the timing control is shifted from the second peak to the first peak with a resultant increase or advance in timing.

The capacitor discharge systems discussed hereinbefore are generally suitable for their intended use to advance the ignition timing at high engine speeds. However, in many applications of capacitor discharge systems for the ignition timing control of small engine such as in chain saws, plastic cord grass cutters and the like, it would be desirable to provide engine speed control via the capacitor discharge system to prevent excessively high engine speeds under no load conditions or other situations in which the speed of the engine increases sharply beyond desirable operating speeds. The capacitor discharge system of the prior art provide a relative measure of ignition timing retard at high engine speeds as evidenced by the prior art arrangements to overcome ignition timing retard and to provide ignition timing advance at higher engine speeds. However, the arrangements of the prior art do not provide a significant predetermined ignition timing retard characteristics at high engine speeds to achieve engine speed control and to prevent engine damage due to excessively high speeds.

For example, the capacitor ignition system of U.S. Pat. No. 4,036,201 exhibits several degrees of ignition timing retard at higher engine speeds. Attempts to increase the ignition timing retard by increasing the inductance of the primary winding of the ignition transformer results in a lowering of the ignition voltage or an impractical size of the ignition transformer.

SUMMARY OF THE INVENTION

It is a principal object of the present invention to provide a new and improved capacitor discharge ignition system that provides a predetermined ignition timing retard characteristic at high engine speeds.

It is another object of the present invention to provide an engine speed control arrangement in a capacitor discharge ignition system to prevent excessively high engine speeds.

It is another object of the present invention to provide a capacitor discharge ignition system that generates high output voltages while preventing excessive reverse voltages to the various components of the system.

Briefly, these and other objects of the present invention are achieved by providing an ignition timing control arrangement to achieve a predetermined ignition timing retard characteristic at high engine speeds and thus provide engine speed control. The capacitor discharge ignition system is positioned adjacent a rotating permanent magnet that is rotated over a path in synchronism with the operation of an engine to be controlled.

The capacitor discharge ignition system includes a stator core having disposed thereon an ignition coil and a control coil. As a first pole of the magnet passes the stator core, a voltage and current of a first polarity is induced in the control coil to charge a storage capacitor. As the second pole of the magnet passes the stator core, a voltage and current of the opposite polarity is induced in the control coil and a control arrangement responsive to the control coil discharges the capacitor into a primary winding of the ignition coil. The induced voltage and current in a secondary winding of the ignition coil provides suitable power conditions to fire a spark plug or spark plugs connected across the secondary winding.

BRIEF DESCRIPTION OF THE DRAWINGS

The invention both as to its organization and method of operation together with further objects and advantages thereof will best be understood by reference to the following specification taken in connection with the accompanying drawings in which.

DESCRIPTION OF THE PREFERRED EMBODIMENT

Figure 1:
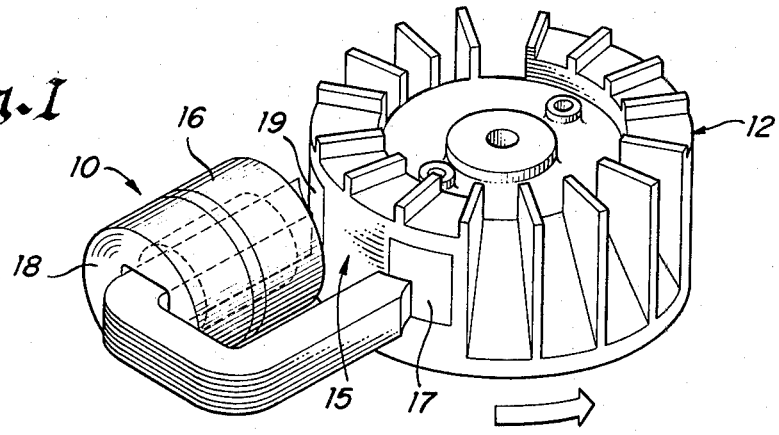
FIG. 1 is a perspective view of the capacitor discharge ignition system of the present invention in operation adjacent a flywheel of an engine.
Figure 2:
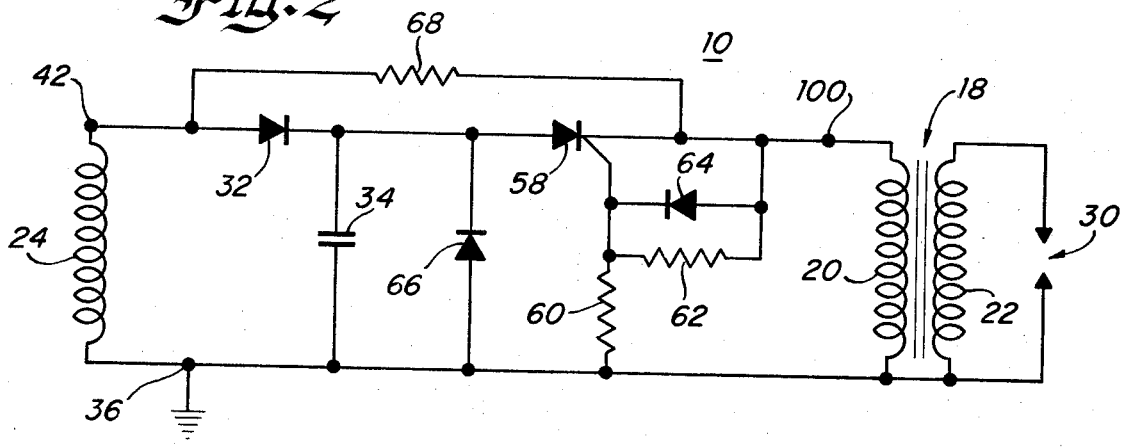
FIG. 2 is an electrical schematic diagram of the capacitor discharge ignition system of the present invention as shown in FIG. 1.

Referring now to the drawings and more particularly to FIG. 1, the capacitor discharge ignition (CDI) system of the present invention referred to generally at 10 is shown in operative position adjacent a flywheel 12 of an engine. The flywheel 12 carries a permanent magnet referred to generally at 15 that energizes and controls the basic timing of the CDI system 10 upon rotation of the flywheel 12. The permanent magnet 15 includes two magnet pole faces or pieces 17 and 19. The CDI system 10 includes a generally U-shaped stator core 14. A control coil 16 and an ignition coil 18 are disposed on one leg of the stator core 14. Referring now additionally to FIG. 2, the ignition coil 18 includes a primary winding 20 and a secondary winding 22. The control coil 16 includes a control winding 24. In a specific embodiment, the primary winding 20 and the secondary winding 22 are concentrically arranged on the stator core 14 with the charge coil 16 disposed along the stator core 14 adjacent the ignition coil 18.

The ignition coil 18 of the CDI system 10 of the present invention is arranged to fire a spark plug generally indicated at 30 and connected across the secondary winding 22. It should also be understood that the secondary winding 22 in other arrangements is connected to a plurality of spark plugs through an appropriate distributor system. The control winding 24 at one end referred to at reference point 42 is connected through a diode 32 anode to cathode to one end of a charging capacitor 34. The other end of the capacitor 34 and the other end of the control winding 24 are connected to a ground reference indicated generally at 36.

Figure 3:
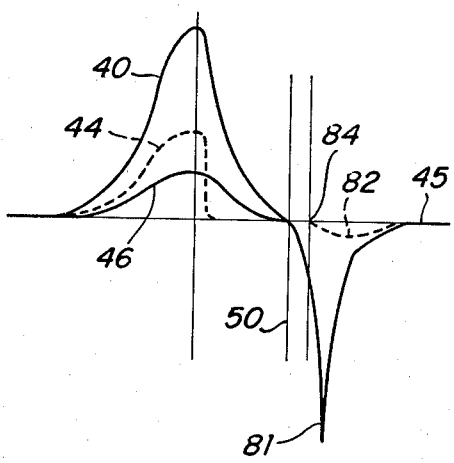
FIG. 3 is a graphical representation of the voltage and current waveforms present during the operation of the capacitor discharge ignition system of FIG. 2.

During operation of the CDI system 10 and referring now additionally to FIG. 3, as the leading magnet pole 17 of the permanent magnet 15 on the rotating flywheel 12 approaches the stator 14, a voltage is induced in the control winding 24 represented graphically by the waveform 40. The voltage waveform 40 is referenced to the coil end 42 of the control winding 24. A corresponding current represented by the waveform 44 of FIG. 3 flows through the diode 32 to charge the capacitor 34. As the leading magnet pole 17 leaves the proximity of the stator core 14, the induced voltage in the control winding 24 and the corresponding current flowing into the capacitor 34 will decrease as shown by the respective waveforms 40 and 44 in FIG. 3. Due to the presence of the diode 32, the charge on the capacitor 34 will be retained. As the leading magnet pole 17 moves past the stator core 14, a voltage will also be induced in the primary winding 20 of the ignition coil 18 as represented by the waveform 46 in FIG. 3.

The reference line 50 in FIG. 3 represents the respective points of the waveforms 40, 44 and 46 at the time of operation during rotation of the flywheel 12 as the leading magnet pole 17 passes away from the stator core 14 and before the arrival of the trailing magnet pole 19 of the permanent magnet 15. While the vertical axis or ordinate of the graphical representation of FIG. 3 represents the magnitude of the voltage or current of the respective waveforms 40, 44 and 46, the horizontal axis or abscissa 45 represents the angular rotation of the flywheel 12. As the trailing pole 19 of the permanent magnet approaches the stator core 14, the polarity of the induced voltage in the control winding 24 reverses and a voltage is induced of the opposite polarity with respect to the coil end 42 of the control winding 24.

Referring again to FIG. 2, the primary winding 20 is connected between the ground reference 36 and the cathode of a discharging control SCR 58 identified at reference point 100. The junction of the charging capacitor 34 and the cathode of diode 32 is connected to the anode of the discharging control SCR 58. The gate or control electrode of the discharging control SCR 58 is connected through a resistor 60 to the ground reference 36. The gate or control electrode of the SR 58 is also connected through a resistor 62 to the cathode of the SCR 58. The resistors 60 and 62 provide a triggering network for the SCR 58. A protection diode 64 is connected anode to cathode between the cathode and gate of the SCR 58 to prevent excessive reverse breakdown voltages across the cathode to gate junction of the SCR 58.

In accordance with important aspects of the present invention, a limiting diode 66 is connected anode to cathode between the ground reference 36 and the anode of the SCR 58 to shunt high voltage ringing after the discharge of the capacitor 34 and to protect the diode 32 from excessive reverse voltages. In accordance with important aspects of the present invention, a resistor 68 is connected between the coil end 42 of the control winding 24 and the cathode of the SCR 58 to provide a triggering path from the control winding 24 and the gate to cathode junction of the SCR 58 and also to control high voltage ringing after discharge of the capacitor 34 and to protect the diode 32 from excessive reverse voltages.

In accordance with important aspects of the present invention, the resistor 68 in addition to achieving timing control by the control winding 24 functions in combination with the limiting diode 66 to achieve high output voltages at 30 while preventing excessive reverse voltages across the diode 32. In conventional capacitor discharge systems, a diode shunting the control winding 24 results in a lower output voltage at 30. However, removal of the shunting diode across the control winding 24 results in high reverse voltage across the diode 32 due to both ringing conditions and to the high induced voltages across the control winding 24 in a negative sense with respect to the coil end 42.

In the arrangement of FIG. 2, the primary winding 20 and the control winding 24 are arranged to have induced voltages of a common polarity with respect to the coil end 42 of the control winding 24 and the coil end 100 of the primary winding 20.

Referring now to FIG. 3 and considering the operation of the CDI system 10, as the trailing magnet pole 19 of the permanent magnet 15 passes the stator core 14, a voltage is induced in the control winding 24 as represented by the waveform 80. The induced voltage in the control winding 24 decreases sharply to a negative peak 81 as the trailing pole 90 is approximately positioned adjacent the stator core 14. As the trailing magnet pole 19 leaves the vicinity of the stator core 14, the induced voltage waveform 80 returns toward the base line 45. Thus, as the trailing magnet pole 19 moves through the vicinity of the stator core 14, a negative voltage is induced across the control winding 24 at the coil end 42 with respect to the reference potential 36, represented graphically by the base line axis 45. The charge capacitor 34 is isolated by the diode 32 and the charge across the capacitor 34 is maintained.

Accordingly, with the capacitor 34 isolated from the control winding 24, the remaining circuit is highly inductive and the resultant current flowing from the control winding 24 and represented by waveform 82 of FIG. 3 appreciably lags the voltage waveform 80. As the voltage represented by the waveform 80 is induced across the control winding 24, the resultant current represented by the waveform 82 flows through the series combination of the resistor 60, the gate to cathode junction of the SCR 58, and the resistor 68. The SCR 58 is triggered when the appropriate combination of triggering voltage and triggering current are simultaneously present across the gate to cathode junction of the SCR 58. Upon triggering of the SCR 58, the capacitor 34 is discharged into the primary winding 20 of the ignition coil 18. The discharge of the capacitor 34 that occurs through the primary winding 18 induces a high voltage pulse in the secondary winding 22 of the ignition coil 18 to provide the appropriate power conditions to fire the spark plug connected at 30 across the secondary winding 22.

The point of angular revolution of the flywheel 12 at which the triggering of the SCR 58 occurs is indicated by the reference line 84. Over wide ranges of engine speed or RPM, the triggering point 84 will occur at different angular positions of the flywheel 12 representing different positions of angular revolution along the base line axis 45. Correspondingly, the engine timing will also vary since engine timing is defined as the occurrence of the ignition spark relative to the angular position of the flywheel. This occurs due to the time lag produced by the phase difference between the current waveform 82 and the voltage waveform 80 of the control winding 24. For increasing engine RPM or flywheel speed, this results in a predetermined ignition spark retardation relative to the ignition timing at lower engine RPM to achieve engine speed control.

Figure 4:
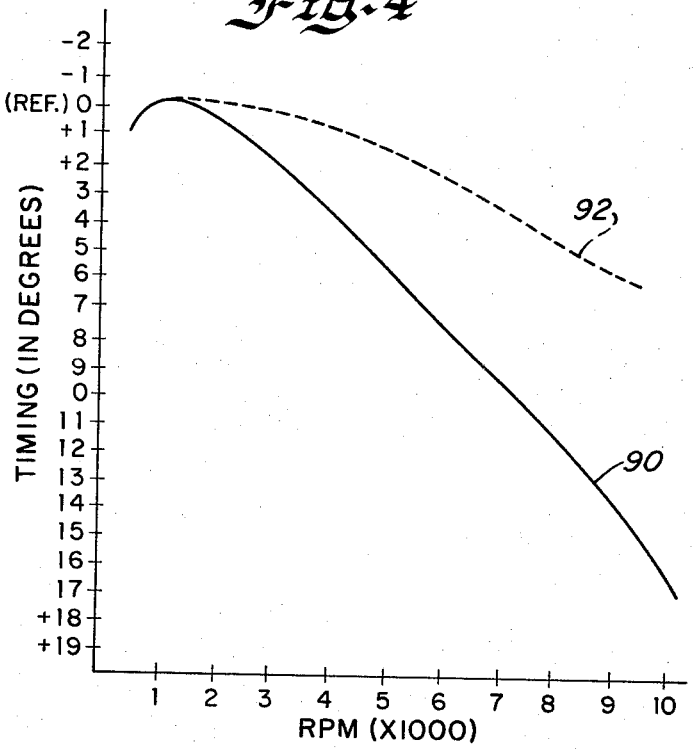
FIG. 4 is a graphical representation of the timing characteristics of the capacitive discharge ignition system of the present invention with respect to engine speed and illustrating the effect of the timing control arrangement of the present invention.

In accordance with the operation of the present invention and referring now to FIG. 4, the ignition timing in degrees is plotted along the vertical axis or ordinate and the engine speed or RPM is plotted along the horizontal axis or abscissa. The curve 90 represents the variation in ignition timing of one illustrative embodiment of the capacitor discharge ignition system of the present invention over a relatively wide range of engine speeds and illustrates a significant predetermined timing retardation at increasing engine speed. The ignition timing retardation at higher engine speeds is a consequence of the later triggering of the SCR 58 as measured by angular revolution of the flywheel 12 due to the phase difference of the current waveform 82 with respect to the voltage waveform 80. The number of degrees of ignition timing retardation described by the curve 90 is dependent on the inductance of the control winding 24. Thus, higher inductance values for the control winding 24 result in a larger predetermined ignition timing retardation while lower inductance result in a smaller predetermined ignition timing retardation at higher engine RPM relative to to an ignition timing reference, e.g. a zero degree reference at 1000 RPM. Accordingly, the control winding 24 of the present invention determines the ignition timing and the inductance of the control winding determines the predetermined ignition timing retard characteristics over the range of engine operating speeds.

The curve 92 of FIG. 4 represents a typical ignition timing characteristic of conventional capacitor discharge ignition systems for illustrative purposes. It should be noted that conventional capacitor discharge ignition system achieve only a slight ignition timing retard characteristic at high engine speeds. While the curves 90 and 92 are depicted as having equal timing references at 1000 RPM, it should be realized that various ignition systems exhibit different absolute timing characteristics relative to the angular position of the engine flywheel 12, e.g. an index point on the flywheel 12. Thus, the index or timing reference point of the flywheel 12 in terms of angular revolution is modified to achieve the appropriate ignition timing reference at a predetermined engine speed. For example, the capacitor discharge ignition system of the present invention exhibits a substantial advance in ignition timing with respect to conventional capacitor discharge ignition systems and thus an appropriate timing index modification is utilized for an appropriate resultant ignition timing reference point.

Thus in accordance with the predetermined ignition timing retardation characteric 90 of the present invention, engine speed control is achieved to prevent engine damage due to high engine speeds in excess of desirable operating speeds.

Engine speed control of this type is desirable in engine applications such as power saws, plastic core grass cutters and the like wherein a no load engine condition may occur. For example, a no load engine condition occurs in a plastic cord grass cutter when the plastic cord breaks or is removed.

In a specific embodiment of the CDI system 10 of the present invention, the following parameters have been found to be suitable although they are illustrative only and should not be interpreted in a limiting sense: control winding 24, 3000 turns, primary winding 20, 50 turns; secondary winding 22, 6000 turns. In specific embodiments of the present invention for applications where a lower predetermined ignition timing retard characteristic is desirable, a control winding of approximately 1500-1800 turns is utilized.

While there has been illustrated and described various embodiment of the present invention, it will be apparent that various changes and modifications thereof will occur to those skilled in the art. It is intended in the appended claims to cover all such changes and modifications as fall within the true spirit and scope of the present invention.

What is claimed and desired to be secured by Letters Patent of the United States is:

1. In a capacitor discharge ignition system for use with a rotating permanent magnet including two poles that is rotated over a path in synchronism with the operation of an engine, the combination of:

means positioned adjacent the path of the permanent magnet for generating a charging supply and for generating a triggering signal in response to induced voltages and currents resulting from the rotating permanent magnet, said generating means comprising a core of ferromagnetic material, and a control winding disposed on said core and having induced therein a voltage and current of a first polarity to generate said charging supply in response to the passage of a first pole of the magnet and having induced therein a voltage and current of opposite polarity to said first polarity to generate said triggering signal in response to passage of the second pole of said magnet;

storage means connected to said generating means and being charged in response to said charging supply for storing said energy delivered from said charging supply;

ignition coil means disposed on said core for receiving energy and for generating an ignition voltage in response to said received energy; and means independent of said storage means and said generating means responsive to said triggering signal for controlling the discharge of said storage means into said ignition coil means, said controlling means comprising circuit means and electronic switch semiconductor means having anode, cathode and control connections, said anode being connected to said storage means and said cathode being connected to said ignition coil, said circuit means providing a first resistive circuit path between one end of said control winding and said control connection of said electronic switch semiconductor means and a second resistive circuit path between the second end of said control winding and said cathode of said electronic switch semiconductor means.

2. The capacitor discharge ignition system of claim 1 further comprising means for providing a predetermined ignition timing characteristic to said ignition voltage with respect to the speed of operation of said engine to establish a substantial retarded ignition timing characteristic at high engine speeds above normal desired operation speeds.

3. The capacitor discharge ignition system of claim 2 wherein said predetermined ignition timing characteristic providing means comprises a predetermined value of the inductance of said control winding.

4. The capacitor discharge ignition system of claim 3 wherein said predetermined ignition timing characteristic providing means further comprises said circuit path means providing a predetermined impedance between said cathode of said SCR semiconductor means and said second end of said control winding.

5. The capacitor discharge ignition system of claim 1 wherein said electronic switch semiconductor means is an SCR.

6. The capacitor discharge ignition system of claim 1 wherein said storage means comprises a capacitor and a charging diode, said charging diode having an anode being connected to said second end of said control winding and a cathode connected to said anode of said SCR semiconductor means, said capacitor being connected between said anode of said electronic switch semiconductor means and said one end of said control winding.

7. The capacitor discharge ignition system of claim 6 further comprising diode circuit means being connected across said capacitor, said diode circuit means having a cathode connected to said anode of said SCR semiconductor means and an anode connected to said one end of said control winding.

8. The capacitor discharge ignition system of claim 6 wherein said ignition coil comprises a primary and a secondary winding, said cathode of said SCR semiconductor means being connected to one end of said primary winding, the second end of said primary winding being connected to said one end of said control winding, said secondary winding generating said ignition voltage.

9. The capacitor discharge ignition system of claim 8 wherein said control winding is arranged with respect to the rotating path of said permanent magnet to induce a positive voltage at said second end of said control winding in response to the passage of said first pole.

10. In a capacitor discharge ignition system for use with a rotating permanent magnet including two poles that is rotated over a path in synchronism with the operation of an engine, the combination of:

means positioned adjacent the path of the permanent magnet for generating a charging supply and for generating a triggering signal in response to induced voltages and currents resulting from the rotating permanent magnet, said generating means comprising a core of ferromagnetic material, and a control winding disposed on said core and having induced therein a voltage and current of a first polarity to generate said charging supply in response to the passage of a first pole of the magnet and having induced therein a voltage and current of opposite polarity to said first polarity to generate said triggering signal in response to passage of the second pole of said magnet;

storage means connected to said generating means and being charged in response to said charging supply for storing said energy delivered from said charging supply;

ignition coil means disposed on said core for receiving energy and for generating an ignition voltage in response to said received energy; and means responsive to said triggering signal for controlling the discharge of said storage means into said ignition coil means, said capacitor discharge ignition system providing a predetermined ignition timing characteristic to said generated ignition voltage, said predetermined ignition timing characteristic including a predetermined ignition retard of at least 10 degrees at engine speeds in excess of desired operating speeds with respect to the ignition timing at a reference speed in the normal operating speed range of the engine, said predetermined ignition retard corresponding to a predetermined inductance value of said control winding.

11. In a capacitor discharge ignition system for use with a rotating permanent magnet including two poles that is rotated over a path in synchronism with the operation of an engine, the combination of:

means positioned adjacent the path of the permanent magnet for generating a charging supply and for generating a triggering signal in response to induced voltages and currents resulting from the rotating permanent magnet, said generating means comprising a control winding having induced therein a voltage and current of a first polarity to generate said charging supply in response to the passage of a first pole of the magnet and having induced therein a voltage and current of opposite polarity to said first polarity to generate said triggering signal in response to passage of the second pole of said magnet;

storage means connected to said generating means and being charged in response to said charging supply for storing said energy delivered from said charging supply;

ignition coil means for receiving energy and for generating an ignition voltage in response to said received energy;

means responsive to said triggering signal for controlling the discharge of said storage means into said ignition coil means; and engine speed control means for providing a predetermined ignition timing retard characteristic with respect to engine speed to establish an ignition timing retard characteristic of at least 10 degrees above predetermined desired operating speeds with respect to a reference speed in the normal operating speed range of the engine, said predetermined ignition retard characteristic providing an increasing ignition retard with increasing engine speeds in excess of normal operating speeds, said engine speed control means including said control winding and said predetermined ignition timing retard characteristic being determined by the inductance of said control winding.

12. A capacitor discharge ignition system for use with a rotating permanent magnet in synchronism with the operation of an engine, said capacitor discharge ignition system comprising:

a core of ferromagnetic material positioned adjacent the path of the rotating permanent magnet;

a control winding disposed on said core for generating a charging supply and for generating a trigger signal in response to said rotating permanent magnet, said charging supply and said trigger signal corresponding to generated voltages of opposite polarity in said control winding;

a charging capacitor;

a charging diode having an anode connected to a first end of said control winding corresponding to a positive generated voltage during generation of said charging supply and a cathode connected to a first end of said charging capacitor, said second end of said charging capacitor being connected to said second end of said control winding;

an SCR having an anode connected to said cathode of said charging diode, said SCR further including a cathode and a control connection;

an ignition coil disposed on said core and including a primary winding and a secondary winding, one end of said primary winding being connected to said cathode of said SCR, the second end of said primary winding being connected to said junction of said capacitor and said control winding; and trigger control circuit means for connecting said control connection and said cathode of said SCR across said control winding whereby said capacitor is charged in response to said generated charging supply of said control winding and said SCR is triggered to discharge said charging capacitor into said primary winding in response to said generated trigger signal in said control winding, said secondary winding generating an ignition voltage in response to said capacitor being discharged into said primary winding.

13. The capacitor discharge ignition system of claim 12 wherein said trigger control circuit means comprises a resistor connected between said cathode of said SCR and said first end of said control winding.

14. The capacitor discharge ignition system of claim 13 further comprising a diode having an anode connected to said second end of said capacitor and a cathode connected to said first end of said capacitor.

15. The capacitor discharge ignition system of claim 12 wherein said control winding comprises a predetermined inductance to provide a predetermined ignition timing characteristic of said ignition voltage to establish a substantial retarded ignition timing characteristic at high engine speeds above normal desired operating speeds.

16. A capacitor discharge ignition system for use with a rotating permanent magnet that is rotated in synchronism with the operation of an engine, said capacitor discharge ignition system comprising:

means positioned adjacent the path of the permanent magnet for generating a charging supply and for generating a triggering signal in response to said rotating permanent magnet, said generating means comprising a control winding, said charging supply and said trigger signal corresponding to respective generated voltages of opposite polarity in said control winding;

a charging and storage circuit comprising a charging diode and a charging capacitor connected in a series circuit configuration with said control winding, said charging diode poled to pass current from said control winding to said charging capacitor when said charging supply is generated;

an ignition coil for receiving energy from said charging capacitor and for generating an ignition voltage in response to said received energy;

means responsive to said triggering signal for controlling the discharge of said charging capacitor into said ignition coil, said discharge controlling means comprising electronic switch device means including anode, cathode and control connections, said anode being connected to said charging capacitor, said cathode being connected to said ignition coil, said discharge controlling means further comprising circuit means connecting said control connection of said electronic switch device means to apply said triggering signal of said control winding; and protection circuit control means for protecting said control winding and said charging diode from high reverse voltages, for increasing the ignition voltage of said ignition coil, for controlling high voltage ringing after the discharge of said charging capacitor, and for providing a circuit path from said cathode connection of said electronic switch device means to said control winding, said protection circuit control means comprising a shunting diode connected across said charging capacitor and poled to conduct when the voltage across said charging capacitor is of opposite polarity to the voltage across said capacitor when said charging supply is generated, said protection circuit control means further comprising a resistor connected between said cathode of said electronic switch device means and the winding end of said control winding that is positive with respect to said other winding end when said charging supply is generated.

* * * * *